US010665406B2

(12) United States Patent
Sasaki et al.

(10) Patent No.: US 10,665,406 B2
(45) Date of Patent: May 26, 2020

(54) CONTACT MECHANISM AND AN ELECTROMAGNETIC RELAY PROVIDED THEREWITH

(71) Applicant: OMRON Corporation, Kyoto-shi, Kyoto (JP)

(72) Inventors: Jun Sasaki, Kumamoto (JP); Kazuhiro Tsutsui, Kumamoto (JP)

(73) Assignee: OMRON Corporation, Kyoto-shi (JP)

( * ) Notice: Subject to any disclaimer, the term of this patent is extended or adjusted under 35 U.S.C. 154(b) by 225 days.

(21) Appl. No.: 15/679,378

(22) Filed: Aug. 17, 2017

(65) Prior Publication Data

US 2017/0345597 A1 Nov. 30, 2017

Related U.S. Application Data

(63) Continuation of application No. PCT/JP2016/056628, filed on Mar. 3, 2016.

(30) Foreign Application Priority Data

Mar. 20, 2015 (JP) ..... 2015-058403

(51) Int. Cl.
*H01H 1/26* (2006.01)
*H01H 50/54* (2006.01)
(Continued)

(52) U.S. Cl.
CPC ..... *H01H 50/54* (2013.01); *H01H 1/26* (2013.01); *H01H 50/56* (2013.01); *H01H 50/60* (2013.01);
(Continued)

(58) Field of Classification Search
CPC ..... H01H 1/26; H01H 1/62; H01H 50/28; H01H 50/54; H01H 50/546; H01H 50/56; H01H 50/60; H01H 50/64
See application file for complete search history.

(56) References Cited

U.S. PATENT DOCUMENTS 4,683,358 A 7/1987 Dittmann
6,943,653 B2 * 9/2005 Hanke ..... H01H 61/0107 200/405
(Continued)

FOREIGN PATENT DOCUMENTS

CN 102969205 A 3/2013
CN 103094007 A 5/2013
(Continued)

OTHER PUBLICATIONS

English translation of Written Opinion of PCT/JP2016/056628 dated Apr. 19, 2016 from the International Searching Authority.
(Continued)

*Primary Examiner* — Ramon M Barrera
(74) *Attorney, Agent, or Firm* — Metrolex IP Law Group, PLLC

(57) ABSTRACT

A contact mechanism includes: a movable touch piece that includes a caulking portion, a pair of arms forked from the caulking portion and respectively having free ends, first and second movable contacts provided at the respective free ends of the pair of arms, and a coupler configured to couple the free ends of the pair of arms; and first and second fixed contacts disposed respectively facing the first and second movable contacts contactably to or separably from the first and second movable contacts.

4 Claims, 13 Drawing Sheets

(51) Int. Cl.

| | |
|---|---|
| ***H01H 50/56*** | (2006.01) |
| ***H01H 50/60*** | (2006.01) |
| ***H01H 50/64*** | (2006.01) |
| *H01H 50/28* | (2006.01) |
| *H01H 1/62* | (2006.01) |

(52) U.S. Cl.

CPC ..... *H01H 50/64* (2013.01); *H01H 1/62* (2013.01); *H01H 50/28* (2013.01); *H01H 50/546* (2013.01)

(56) References Cited

U.S. PATENT DOCUMENTS

| | | | |
|---|---|---|---|
| 2002/0036557 | A1 | 3/2002 | Nakamura et al. |
| 2010/0066468 | A1 | 3/2010 | Iwamoto et al. |
| 2011/0121926 | A1 | 5/2011 | Kojima et al. |
| 2013/0057370 | A1 | 3/2013 | Kubono et al. |
| 2013/0113581 | A1 | 5/2013 | Kakimoto et al. |
| 2013/0299323 | A1 | 11/2013 | Tanaka et al. |

FOREIGN PATENT DOCUMENTS

| | | | | |
|---|---|---|---|---|
| CN | 103282993 | A | 9/2013 | |
| DE | 8506345 | U1 | 8/1986 | |
| DE | 102010017875 | A1 * | 10/2011 | ..... H01H 1/26 |
| JP | S55-72754 | U | 5/1980 | |
| JP | H05-31083 | U | 4/1993 | |
| JP | 2002-100275 | A | 4/2002 | |
| JP | 2009-289678 | A | 12/2009 | |
| JP | 2010-73323 | A | 4/2010 | |
| JP | 2012-94294 | A | 5/2012 | |
| JP | 2013-54846 | A | 3/2013 | |

OTHER PUBLICATIONS

The International Search Report of PCT/JP2016/056628 dated Apr. 19, 2016.

The Chinese Office Action (CNOA) dated Jul. 4, 2018 in the counterpart Chinese patent application.

The Japanese Office Action (JPOA) dated May 22, 2018 in a counterpart Japanese patent application.

An examination report dated May 27, 2019 in the counterpart German (DE) patent application.

* cited by examiner

CONTACT MECHANISM AND AN ELECTROMAGNETIC RELAY PROVIDED THEREWITH

CROSS REFERENCE TO RELATED APPLICATIONS

This application is a continuation application of International Application No. PCT/JP2016/056628, filed on Mar. 3, 2016, which claims priority based on the Article 8 of Patent Cooperation Treaty from prior Japanese Patent Application No. 2015-058403, filed on Mar. 20, 2015, the entire contents of which are incorporated herein by reference.

TECHNICAL FIELD

The disclosure relates to a contact mechanism, and an electromagnetic relay provided therewith.

BACKGROUND ART

Among electromagnetic relays, there has hitherto been an electromagnetic relay described in Patent Document 1, for example. This electromagnetic relay is provided with an electromagnetic device including an electric magnet that is excited by electric conduction, and a contact mechanism that brings two fixed contacts and two movable contacts into contact with each other or separate those contacts from each other in association with excitation and demagnetization of the electric magnet.

PRIOR ART DOCUMENT

Patent Document

Patent Document 1: Japanese Unexamined Patent Publication No. 2009-289678

SUMMARY OF THE INVENTION

Problems to be Solved by the Invention

However, in the conventional electromagnetic relay described above, since the movable contacts are respectively provided at free ends of movable touch pieces in a forked shape, the two movable contacts form respective conduction paths independent of each other. Accordingly, for example when a foreign matter is mixed between one set of the contacts and a contact failure then occurs, a current concentrates on the other set of the contacts, to cause abnormal heat generation only in the other conduction path of the movable touch piece. This may result in damage on the movable touch piece and a significant decrease in life of the electromagnetic relay.

In view of the foregoing problem, one or more embodiments may provide a contact mechanism capable of avoiding abnormal heat generation even if a contact failure occurs between one set of contacts, and provide an electromagnetic relay provided with this contact mechanism.

Means for Solving the Problem

In order to solve the above problem, a contact mechanism according to one or more embodiments is provided with: a movable touch piece that includes a fixed portion, a pair of arms forked from the fixed portion and respectively having free ends, first and second movable contacts provided at the respective free ends of the pair of arms, and a coupler configured to couple the free ends of the pair of arms; and first and second fixed contacts disposed respectively facing the first and second movable contacts contactably to or separably from the first and second movable contacts.

Effect of the Invention

According to the contact mechanism in one or more embodiments, the free ends of the forked arms in the movable touch piece are coupled by the coupler. Thus, even if a contact failure occurs in one movable contact and one fixed contact, it is possible to avoid concentration of a current on the other movable contact and the other fixed contact, and to thereby avoid abnormal heat generation of the movable touch piece.

As one or more embodiments, it may be configured such that the coupler is elastically deformed by a smaller force than the arm.

According to one or more embodiments, for example, even if a foreign matter is mixed between one movable contact and one fixed contact and a gap is then formed between these contacts, the contact state between the other movable contact and the fixed contact can be kept to improve contact reliability As one or more embodiments, it may be configured such that an intersection of a straight line and a peripheral edge of the fixed portion is taken as a first fixed portion, the straight line connecting between a center of the first movable contact and a center of the fixed portion disposed at a position with the shortest direct distance to the first movable contact, an intersection of a straight line and a peripheral edge of the fixed portion is taken as a second fixed portion, the straight line connecting between a center of the second movable contact and a center of the fixed portion disposed at a position with the shortest direct distance to the second movable contact, and when the center of the first movable contact, the center of the second movable contact, the first fixed portion, and the second fixed portion are located at respective apexes of a quadrangle and the center of the first movable contact and the second fixed portion are disposed at opposite corners of the quadrangle, a spring constant of the movable touch piece between the first movable contact and the first fixed portion and a spring constant of the movable touch piece between the second movable contact and the second fixed portion are larger than a spring contact of the movable touch piece between the first and second movable contacts, and the direct distance between the first movable contact and the first fixed portion and the direct distance between the second movable contact and the second fixed portion are longer than a direct distance between the first and second fixed portions.

According to one or more embodiments, for example, even if a foreign matter is mixed between one movable contact and one fixed contact and a gap is then formed between these contacts, the state of contact between the other movable contact and the other fixed contact can be kept reliably. This can result in improvement in contact reliability.

Note that in this specification, the center of the fixed portion means the center of the fixed portion projected to the surface of the movable touch piece. Further, the centers of the first and second movable contacts mean the centers of the first and second movable contacts projected to the surface of the movable touch piece.

As one or more embodiments, it may be configured such that the arm and the coupler are members different from each other.

According to one or more embodiments, it is possible to increase the range of design of the contact mechanism.

The electromagnetic relay according to one or more embodiments may include the contact mechanism.

According to the electromagnetic relay of one or more embodiments, the contact mechanism allows avoidance of abnormal heat generation in the movable touch piece.

MODE FOR CARRYING OUT THE INVENTION

Figure 1:
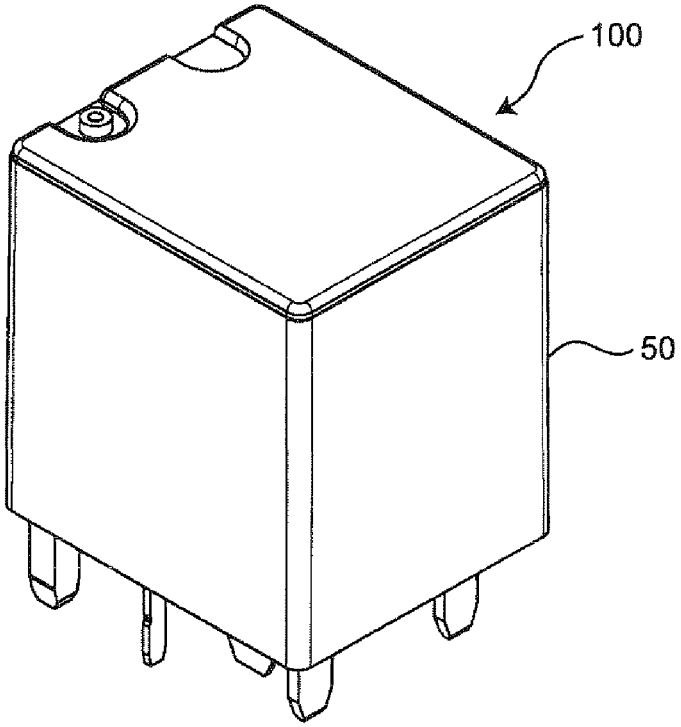
FIG. 1 is a perspective view illustrating an electromagnetic relay provided with a contact mechanism of one or more embodiment.

Hereinafter, embodiments will be described with reference to the accompanying drawings. In the following description, in describing configurations represented in the drawings, terms showing directions such as "up", "down", "left", and "right", and other terms including those, will be used. It is noted that the purpose for using those terms is to facilitate understanding of embodiments through the drawings. Accordingly, those terms do not necessarily show directions used at the time of actually using one or more embodiments. A technical scope of the invention recited in the claims shall not be restrictively interpreted by using those terms.

Figure 2:
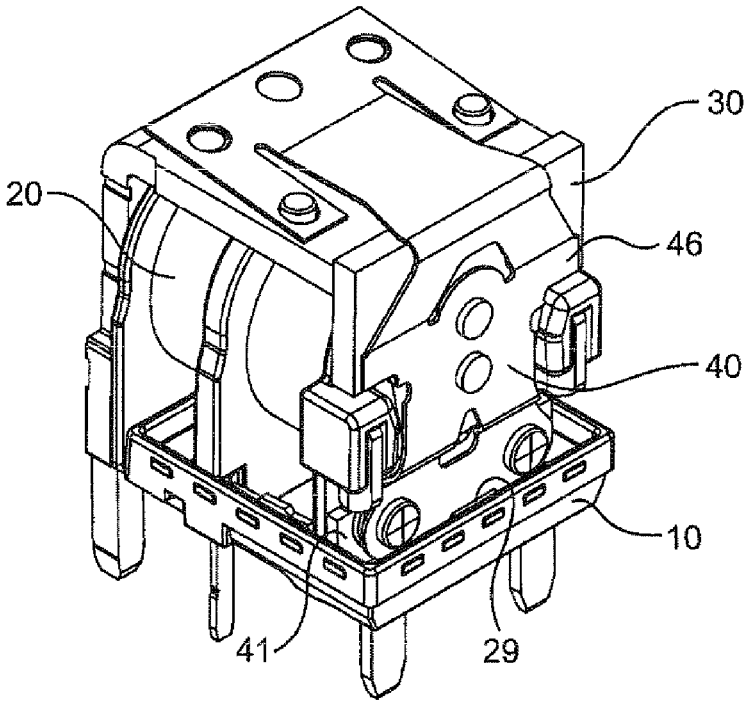
FIG. 2 is a perspective view illustrating a state where a cover of an electromagnetic relay, such as in FIG. 1, has been removed.

As illustrated in FIGS. 1 and 2, an electromagnetic relay 100 provided with a contact mechanism according to one or more embodiments includes: a base 10; an electric magnet device 20, a movable iron piece 30, and a contact mechanism 40 which are provided on the base 10; and a cover 50 that is mounted on the base 10 so as to cover the electric magnet device 20, the movable iron piece 30, and the contact mechanism 40.

Figure 3:
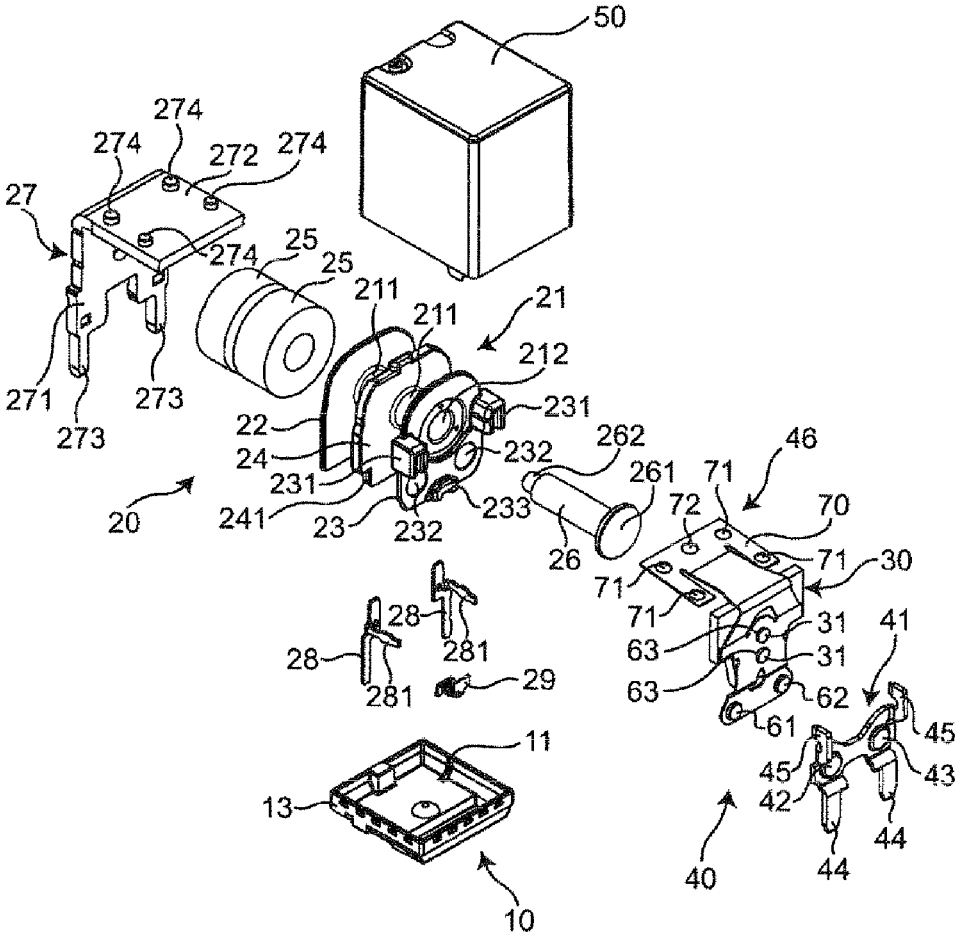
FIG. 3 is an exploded perspective view of an electromagnetic relay, such as in FIG. 1.
Figure 4:
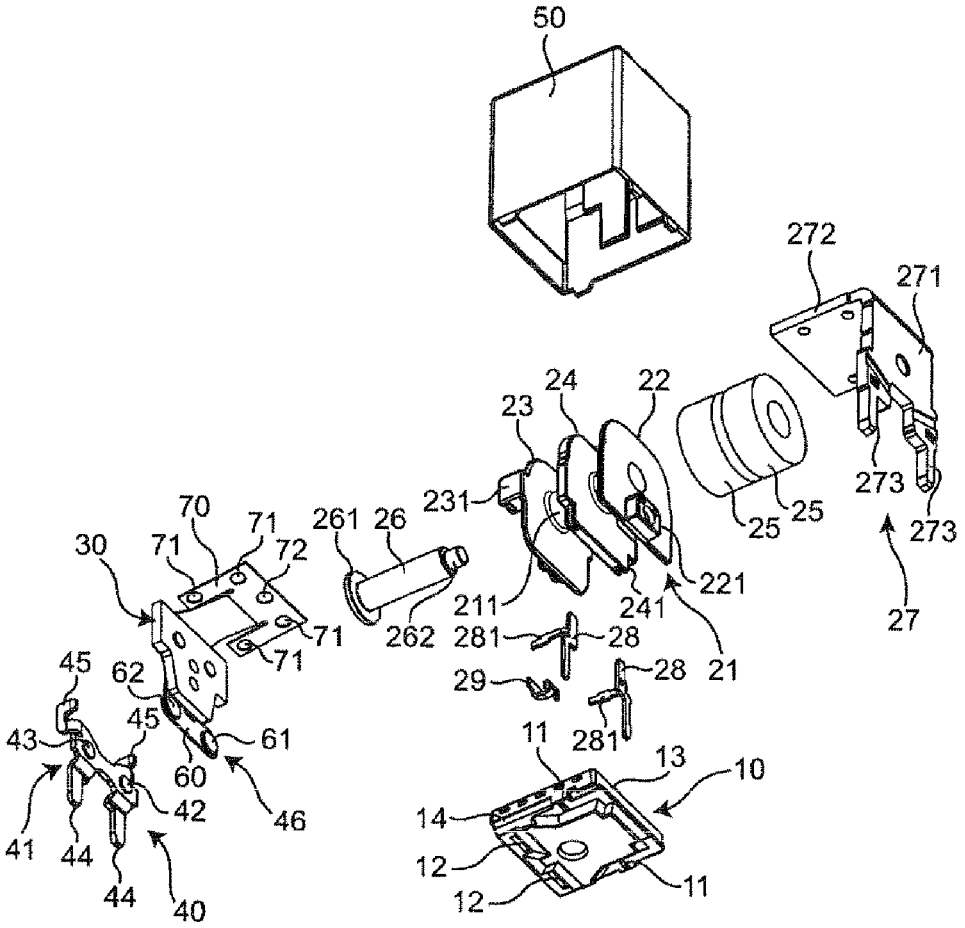
FIG. 4 is an exploded perspective view of an electromagnetic relay, such as in FIG. 1, viewed from a direction different from the exploded perspective view of FIG. 3.

The base 10 has a square shape in a top surface view, as illustrated in FIGS. 3 and 4. This base 10 is provided with a coil terminal hole 11 for press-fitting of a coil terminal 28 of the electric magnet device 20 described later, and a fixed terminal hole 12 (illustrated in FIG. 4) for press-fitting of a fixed terminal 44 of the contact mechanism 40. As illustrate in FIG. 3, a wall 13 extending upward is provided on a peripheral edge of the base 10. Further, as illustrated in FIG. 4, a step 14 is provided on a periphery of the bottom surface of the base 10.

As illustrated in FIGS. 3 and 4, the electric magnet device 20 is made up of a spool 21, two coils 25 wound around the spool 21, an iron core 26 inserted in the spool 21, a yoke 27 coupled with one end of the iron 26, a pair of coil terminals 28, around which lead wires of the coil 25 are wound, and a position regulating member 29 that regulates a moving range of a movable touch piece 46.

The spool 21 is made up of: first and second guard portions 22, 23 respectively provided at both ends; a third guard portion 24 provided between the first and second guard portions 22, 23; and a body 211 that couples the first to third guard portions 22, 23, 24 together.

As illustrated in FIG. 2, the first guard portion 22 is disposed so as to be in contact with the external side surface of the wall 13 of the base 10. As illustrated in FIG. 4, the lower-side center of this first guard portion 22 is provided with a projection 221 for positioning the yoke 27.

As illustrated in FIG. 3, the second guard portion 23 is disposed substantially parallel to the internal side surface of the wall 13 of the base 10 at a predetermined interval. Both sides of this second guard portion 23 are provided with attachments 231 for attachment of a fixed contact terminal 41 described later. Further, both lower corner portions of the second guard portion 23 are provided with recesses 232 for positioning of the first and second fixed contacts 42, 43, and the lower central portion of the second guard portion 23 is provided with an attachment 233 for attachment of the position regulating member 29.

The third guard portion 24 is disposed substantially parallel to the first guard portion 22 and the second guard portion 23.

Notches 241 are provided at both lower ends of the third guard portion 24. Each of these notches 241 is provided with a press-fit groove (not illustrated) for press-fitting of the coil terminal 28. The body 211 is provided in substantially centers of the first to third guard portions 22, 23, 24, and has a through hole 212 for insertion of the iron core 26.

The coil 25 is wound around the body 211 between the first guard portion 22 and the third guard portion 24 of the spool 21, and the body 211 between the second guard portion 23 and the third guard portion 24.

The iron core 26 has a substantially cylindrical shape and is formed of a magnetic material. Both ends of the iron core 26 are provided respectively with a magnetic pole portion 261 for attraction of the movable iron piece 30, and a caulking portion 262 for caulking and fixing to the yoke 27.

The yoke 27 is a substantially L-shaped platy body made of a magnetic material, and made up of a vertical portion 271 and a horizontal portion 272. Terminal portions 273 are provided on both lower ends of the vertical portion 271. In this yoke 27, the vertical portion 271 is in contact with the first guard portion 22 of the spool 21, and a projection 221 of the first guard portion 22 is positioned between the terminal portions 273. Further, each corner portion of the horizontal portion 272 is provided with a protrusion 274 for caulking and fixing of the movable touch piece 46.

The coil terminal 28 includes a binding piece 281 formed by bending and raising, and is press-fitted into a press-fit groove of the third guard portion 24. The binding piece 281 extends along the wall 13 of the base 10 from the notch 241 of the third guard portion 24 of the spool 21. A lead wire of the coil 25 is wound around the binding piece 281.

As illustrated in FIGS. 3 and 4, the movable iron piece 30 is a platy body made of a magnetic member, and has protrusions 31 for caulking and fixing of the movable touch piece 46.

As illustrated in FIGS. 3 and 4, the contact mechanism 40 is made up of a fixed contact terminal 41 and a movable touch piece 46.

The fixed contact terminal 41 is a rectangular platy body having conductivity. The fixed contact terminal 41 includes the first and second fixed contacts 42, 43 which are respectively caulked and fixed to both longitudinal ends, and includes the fixed terminals 44 respectively corresponding to the first and second fixed contacts 42, 43. Further, the longitudinal outer sides of the first and second fixed contacts 42, 43 are provided with press-fit portions 45 for press-fitting of the fixed contact terminal 41 to the attachment 231 of the second guard portion 23.

The movable touch piece 46 is a substantially L-shaped platy body having elasticity and conductivity, and made up of a first planner portion 60 and a second planner portion 70.

First and second movable contacts 61, 62 are provided at free end of the first planner portion 60. The first movable contact 61 is disposed facing the first fixed contact 42 contactably to or separably from the first fixed contact 42. The second movable contact 62 is disposed facing the second fixed contact 43 contactably to or separably from the second fixed contact 43. Further, the first planner portion 60 is provided with a through hole 63 for caulking and fixing of the movable touch piece 46 to the movable iron piece 30.

Each corner portion of the second planner portion 70 is provided with a first through hole 71 for caulking and fixing of the movable touch piece 46 to the yoke 27 of the electric magnet device 20. Moreover, the substantially center of the free end of the second planner portion 70 is provided with a second through hole 72 for provisional holding of the movable touch piece 46 at the time when the movable touch piece 46 is caulked and fixed to the yoke 27.

As illustrated in FIGS. 3 and 4, the cover 50 has a box shape having one open surface and is mounted on the base 10 so as to cover the electric magnet device 20, the movable iron piece 30, and the contact mechanism 40. In the state of the cover 50 mounted on the base 10, the inner peripheral surface of the cover 50 and the step 14 of the base 10 form a groove portion (not illustrated). A sealing member is injected into this groove portion to seal a gap formed between the base 10 and the cover 50.

Next, the operation of the electromagnetic relay 100 will be described.

In the electromagnetic relay 100 before application of a voltage to the coil 25 and excitation of the electric magnet device 20, as illustrated in FIG. 2, the movable touch piece 46 is biased by its own spring force in a direction separated from the fixed contact terminal 41, and is contact with the position regulating member 29. At this time, the first and second movable contacts 61, 62 and the first and second fixed contacts 42, 43 are held in a separate state, and not in contact with each other.

When a voltage is applied to the coil 25 to excite the electric magnet device 20, the iron core 26 is magnetized, and the movable iron piece 30 is attracted to the magnetic pole portion 261. With this, the movable touch piece 46 moves toward the fixed contact terminal 41 along with the movable iron piece 30, whereby the first movable contact 61 and the first fixed contact 42 come into contact with each other, and the second movable contact 62 and the second fixed contact 43 come into contact with each other.

Subsequently, when the application of the voltage to the coil 25 is stopped, the attractive force by the magnetic pole portion 261 of the iron core 26 disappears. With this, the movable touch piece 46 moves by its own spring force in a direction separated from the fixed contact terminal 41, whereby the first movable contact 61 and the first fixed contact 42 are separated from each other, and the second movable contact 62 and the second fixed contact 43 are separated from each other. The movable touch piece 46 then moves until coming into contact with the position regulating member 29.

Subsequently, the first planner portion 60 of the movable touch piece 46 will be described in detail.

Figure 5:
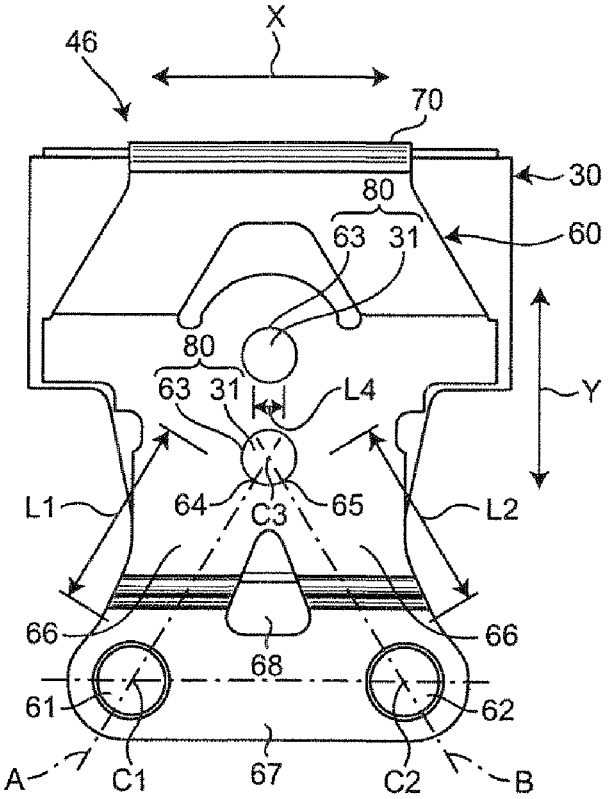
FIG. 5 is a plan view illustrating a first planner portion of a movable touch piece in an electromagnetic relay, such as in FIG. 1.

As illustrated in FIG. 5, the first planner portion 60 of the movable touch piece 46 is provided substantially in the center in an X-direction, and has a plurality of through holes 63 disposed at intervals along a Y-direction. The through hole 63 and the protrusion 31 of the movable iron piece 30 constitute a caulking portion 80 being one example of the fixed portion. The caulking portion 80 is formed by plastic deformation of the protrusion 31 after fitting of the protrusion 31 into the through hole 63, and caulks and fixes the movable touch piece 46 to the movable iron piece 30.

Further, the first planner portion 60 of the movable touch piece 46 includes a pair of arms 66 forked downward in the Y-direction from the caulking portion 80. The first movable contact 61 is provided at the tip of the arm 66 on the left side in the X-direction, and the second movable contact 62 is provided at the tip of the arm 66 on the right side in the X-direction. The tips of the arms 66, which are provided with the first and second movable contacts 61, 62, are respectively free ends, and are coupled to each other by a coupler 67. This coupler 67 is formed integrally with the arms 66, and an opening 68 is provided in a region surrounded by the arms 66 and the coupler 67

Of the plurality of caulking portions 80, the caulking portions 80 having shorter direct distances to the first and second movable contacts 61, 62 are provided with first and second fixed portions 64, 65. In this context, an intersection of a straight line A and a peripheral edge of the caulking portion 80 (i.e., an outer periphery of the through hole 63) is taken as the first fixed portion 64, the straight line A connecting between a center C1 of the first movable contact 61 and a center C3 of the caulking portion 80 (i.e., a center of the through hole 63). An intersection of a straight line B and a peripheral edge of the caulking portion 80 is taken as the second fixed portion 65, the straight line B connecting between a center C2 of the second movable contact 62 and the center C3 of the caulking portion 80.

Note that the center C1, C2 of the first and second movable contacts 61, 62 and the center C3 of the caulking portion 80 are respectively the centers of the first and second movable contacts 61, 62 and the caulking portion 80 projected to the first planner portion 60 of the movable touch piece 46.

The first and second movable contacts 61, 62 and the first and second fixed portions 64, 65 are respectively located at apexes of a quadrangle. The first movable contact 61 and the second fixed portion 65 are disposed at opposite corners, and the second movable contact 62 and the first fixed portion 64 are disposed at opposite corners. Further, the first and second movable contacts 61, 62 and the first and second fixed portions 64, 65 are disposed such that the direct distance between the first movable contact 61 and the first fixed portion 64 is substantially equal to the direct distance between the second movable contact 62 and the second fixed portion 65.

A direct distance L1 between the first movable contact 61 and the first fixed portion 64 is a direct distance from the intersection of the peripheral edge of the first movable contact 61 and the straight line A to the first fixed portion 64. A direct distance L2 between the second movable contact 62 and the second fixed portion 65 is a direct distance from the intersection of the peripheral edge of the second movable contact 62 and the straight line B to the second fixed portion 65.

The first planner portion 60 of the movable touch piece 46 having the above configuration is configured such that the coupler 67, which couples the free ends of the arms 66, is elastically deformed by a smaller force than the arm 66.

That is, a spring constant between the first movable contact 61 and the first fixed portion 64 is referred to as k1, and a spring constant of the first planner portion 60 between the second movable contact 62 and the second fixed portion 65 is referred to as k2. A spring constant of the first planner portion 60 between the first and second movable contacts 61, 62 is referred to as k3, and a direct distance between the first and second fixed portions 64, 65 is referred to as L4. Then, the first planner portion 60 of the movable touch piece 46 is configured such that the spring constants k1, k2 are larger than the spring constant k3, and that the direct distances L1, L2 from the first and second movable contacts 61, 62 to the first and second fixed portions 64, 65 are longer than the direct distance L4.

Note that a spring constant k can be obtained by Formula (1) below. In Formula (1), P is a load, δ is an amount of deflection, b is a width of a movable touch piece, h is a thickness of the movable touch piece, I is a distance from a fixed end to a movable contact, to which the load has been applied, and E is a Young's modulus.

$$k=P/\delta=3EI/l^3=Ebh^3/4l^3 \quad (1)$$

The spring constant k1 (spring constant k2) is calculated by taking the first fixed portion 64 (second fixed portion 65) as a fixed end and applying a vertical load to the center c1 of the first movable contact 61 (the center C2 of the second movable contact 62). Further, the spring constant k3 is calculated by taking one of the centers C1, C2 of the first and second movable contacts 61, 62 as a fixed end and applying a vertical load to the other center. Note that the vertical direction is a direction in which the first movable contact 61 and the second movable contact 62 come in contact with or are separated from the first fixed contact 42 and the second fixed contact 43.

According to the contact mechanism 40 of the above configuration, the first and second movable contacts 61, 62 are provided at the free ends of the forked arm 66 of the movable touch piece, and the coupler 67 couples the free ends with each other. Thus, even if a contact failure occurs in one movable contact and one fixed contact, it is possible to avoid concentration of a current on the other movable contact and the other fixed contact. This can result in avoidance of abnormal heat generation of the movable touch piece 46.

Further, the coupler 67, which couples the free ends of the arms 66, is configured so as to be elastically deformed by a smaller force than the arm 66. That is, the first and second movable contacts 61, 62 and the first and second fixed portions 64, 65 are disposed so as to satisfy: the spring constants k1, k2>the spring constant k3; and the direct distances L1, L2>the direct distance L4. It is thus possible to reduce the deformation of the other movable contact at the time when one movable contact is applied with a load to be deformed. As a result, even if a foreign matter or the like is mixed between one movable contact and one fixed contact and a gap is then formed between the one set of the contacts, the contact state between the other movable contact and the other fixed contact can be kept to improve the contact reliability.

Other Embodiments

Figure 6:
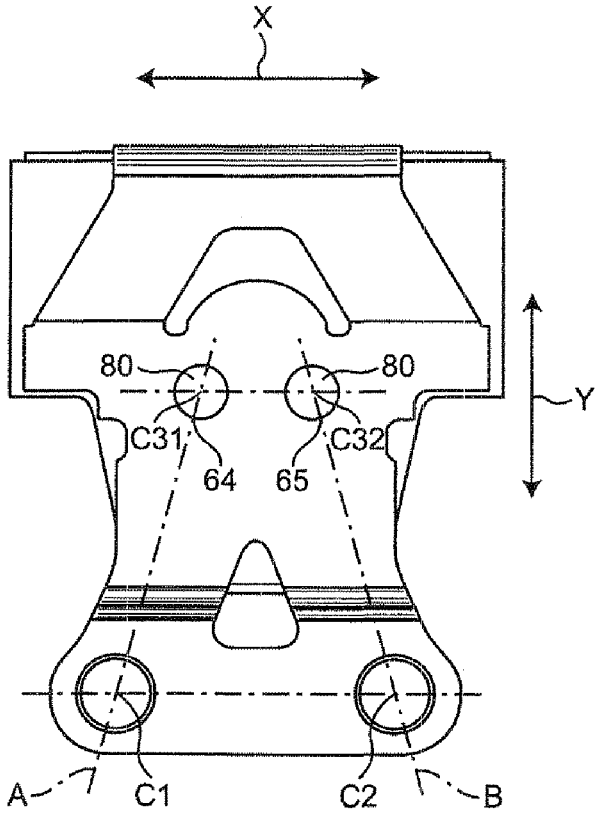
FIG. 6 is a plan view illustrating a first modification of a first planner portion of a movable touch piece in an electromagnetic relay, such as in FIG. 1.
Figure 7:
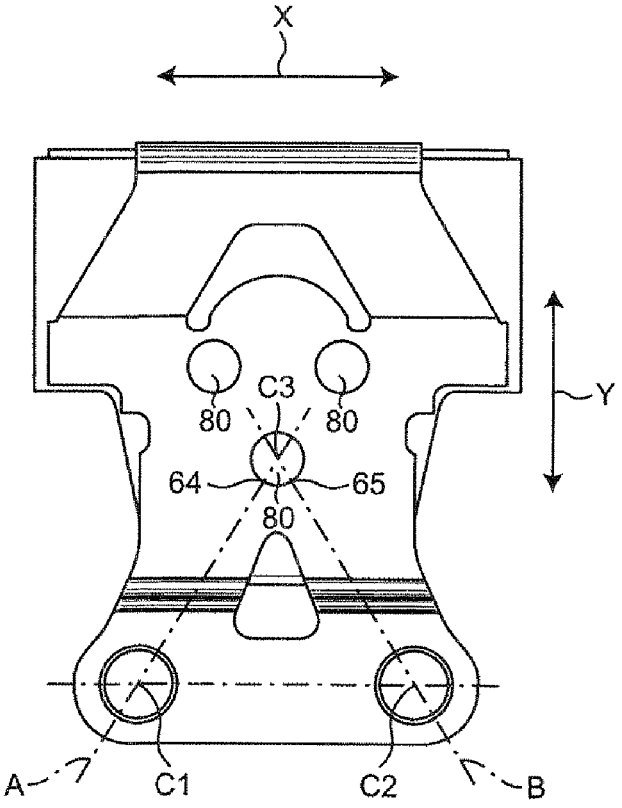
FIG. 7 is a plan view illustrating a second modification of a first planner portion of a movable touch piece in an electromagnetic relay, such as in FIG. 1.

The caulking portion 80 formed by the protrusion 31 of the movable iron piece 30 and the through hole 63 in the first planner portion 60 of the movable touch piece 46 is not restricted to the above embodiments. For example, as illustrated in FIG. 6, the caulking portions 80 may be disposed at an interval in the X-direction. As illustrated in FIG. 7, three caulking portions 80 are provided and disposed such that the respective caulking portions 80 are located at apexes of a triangle.

Figure 8:
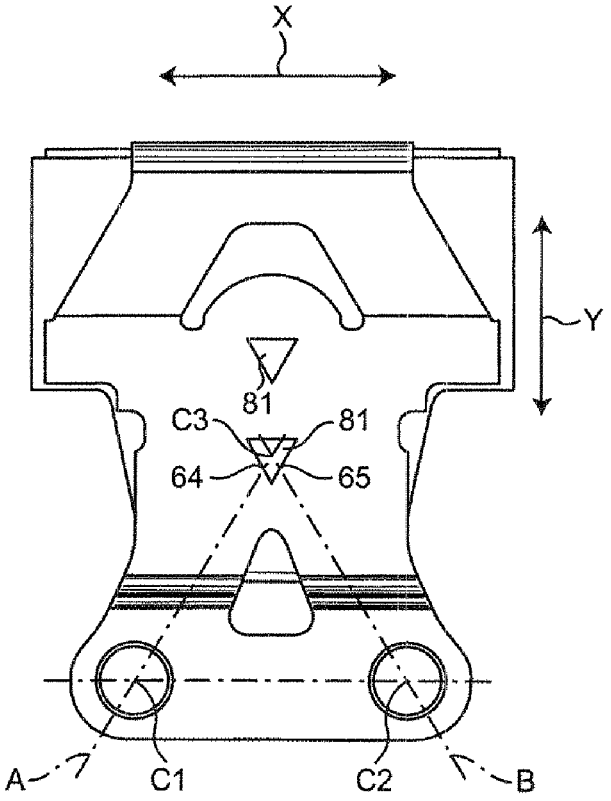
FIG. 8 is a plan view illustrating a third modification of a first planner portion of a movable touch piece in an electromagnetic relay, such as in FIG. 1.
Figure 9:
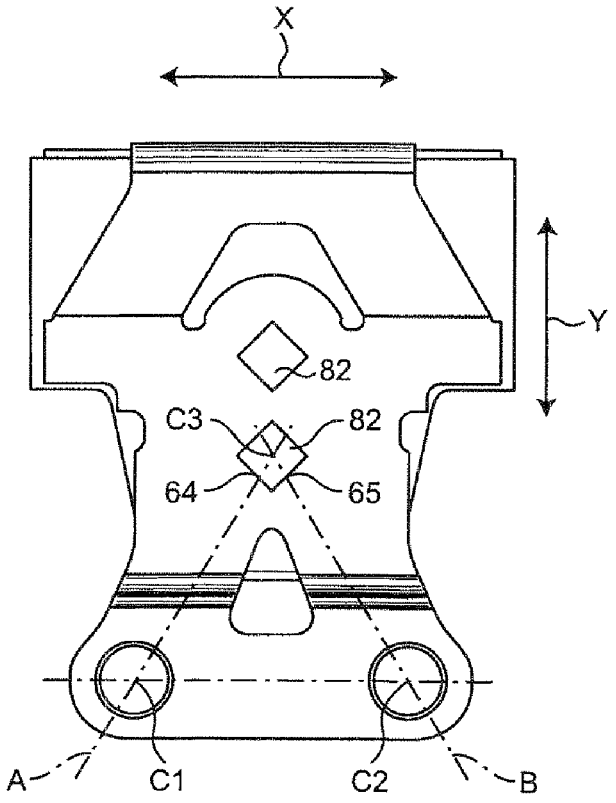
FIG. 9 is a plan view illustrating a fourth modification of a first planner portion of a movable touch piece in an electromagnetic relay, such as in FIG. 1.
Figure 10:
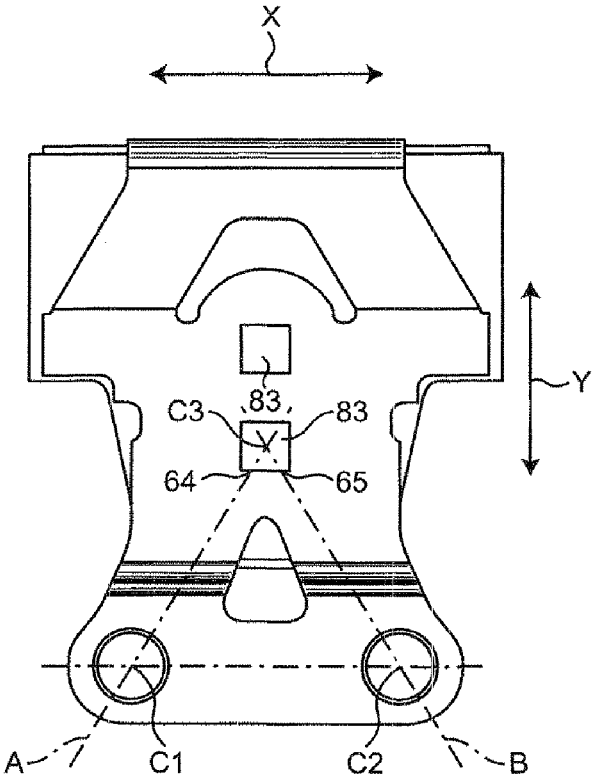
FIG. 10 is a plan view illustrating a fifth modification of a first planner portion of a movable touch piece in an electromagnetic relay, such as in FIG. 1.
Figure 11:
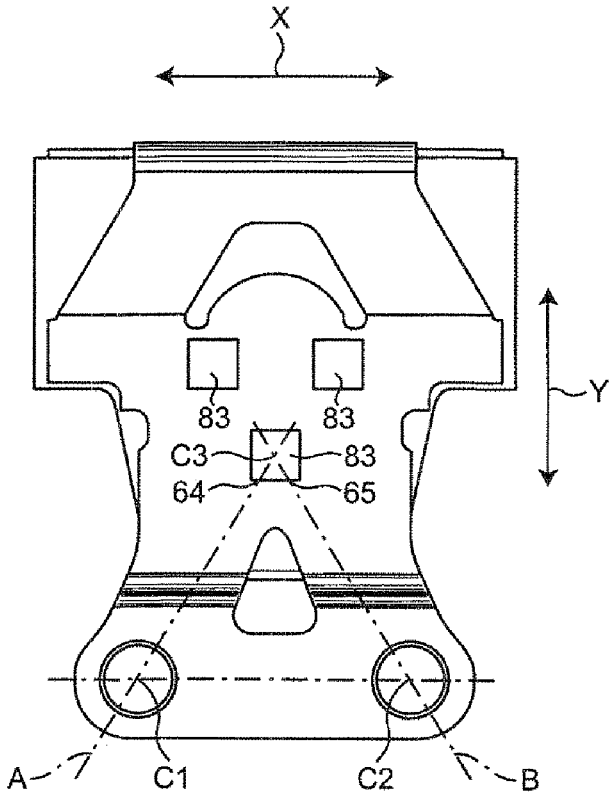
FIG. 11 is a plan view illustrating a sixth modification of a first planner portion of a movable touch piece in an electromagnetic relay, such as in FIG. 1.
Figure 12:
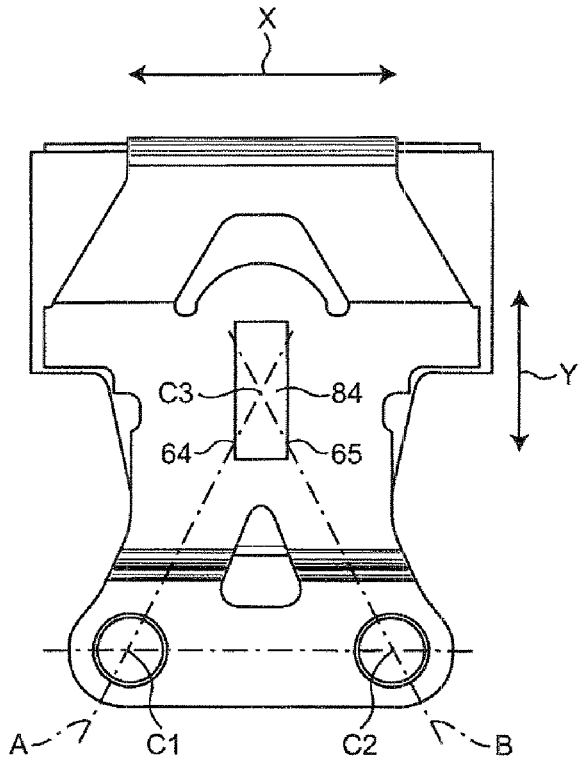
FIG. 12 is a plan view illustrating a seventh modification of a first planner portion of a movable touch piece in an electromagnetic relay, such as in FIG. 1.
Figure 13:
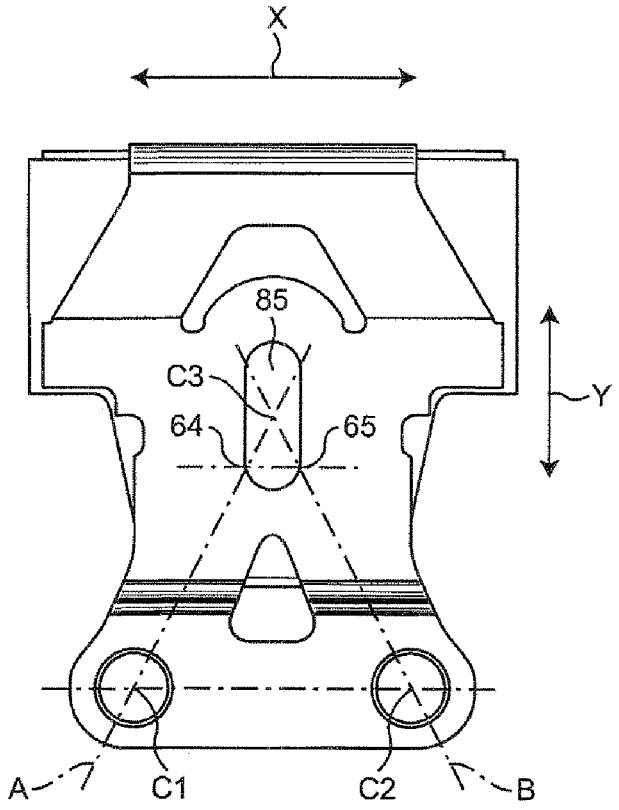
FIG. 13 is a plan view illustrating an eighth modification of a first planner portion of a movable touch piece in an electromagnetic relay, such as in FIG. 1.

As illustrated in FIG. 8, the caulking portion 80 may be a triangular caulking portion 81. Further, the caulking portion 80 may be a rhombic caulking portion 82 illustrated in FIG. 9, may be a square caulking portion 83 illustrated in FIGS. 10 and 11, or may be a rectangular caulking portion 84 illustrated in FIG. 12. Moreover, as illustrated in FIG. 13, the caulking portion 80 may be a caulking portion 85 in a shape formed by adding semicircles to both longitudinal ends of a rectangle.

As thus described, the caulking portion may simply fix the movable touch piece to the movable iron piece, and the shape and the size of the caulking portion, the number of caulking portions installed, and the like can be freely selected and changed.

Note that, even when the shape of the caulking portion is different, the intersection of the straight line A and the peripheral edge of the caulking portion becomes the first fixed portion 64, the straight line A connecting between the center C1 of the first movable contact 61 and a center C31 of the caulking portion located the closest to the first movable contact 61, the caulking portion being located the closest to the first movable contact 61. Further, the intersection of the straight line B and the peripheral edge of the caulking portion becomes the second fixed portion 65, the straight line B connecting between the center C2 of the second movable contact 62 and a center C32 of the caulking portion located the closest to the second movable contact 62, the caulking portion being located the closest to the second movable contact 62

The number of caulking portions may be one, or more than one. For example, as illustrated in FIGS. 5, 7, 8, 9, 10, 11, 12, and 13, when the number of caulking portions located the closest to the first and second movable contacts 61, 62 is one, the first and second fixed portions 64, 65 are provided in different positions on the peripheral edge of the same caulking portion. Further, as illustrated in FIG. 6, when two or more caulking portions are located in different positions in the X-direction, the first fixed portion 64 is provided on the peripheral edge of the caulking portion 80 on the leftmost side in the X-direction, and the second fixed portion 65 is provided on the peripheral edge of the caulking portion 80 on the rightmost side in the X-direction.

Note that the center C3 of each of the caulking portions 80, 81, 82, 83, 84, and 85 illustrated in each of FIGS. 5, 7, 8, 9, 10, 11, 12, and 13 is also a center C31 of the caulking portion located the closest to the first movable contact 61 and a center C32 of the caulking portion located the closest to the second movable contact 62.

Figure 14:
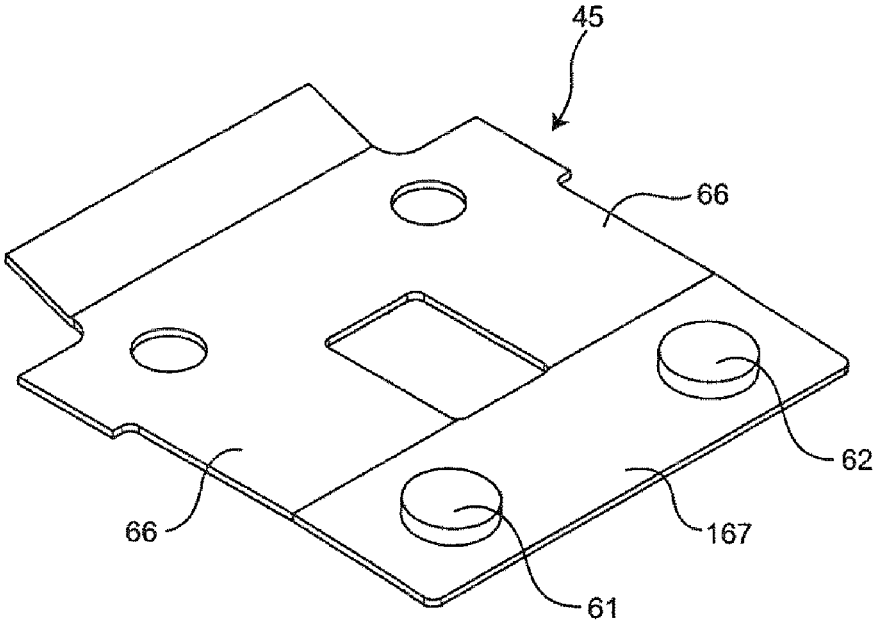
FIG. 14 is a plan view illustrating a ninth modification of a first planner portion of a movable touch piece in an electromagnetic relay, such as in FIG. 1.
Figure 15:
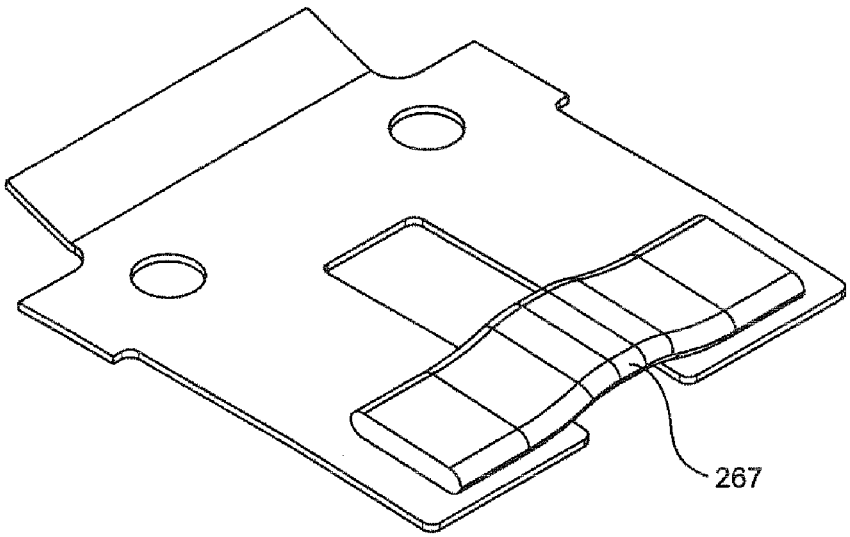
FIG. 15 is a plan view illustrating a tenth modification of a first planner portion of a movable touch piece in an electromagnetic relay, such as in FIG. 1.

The coupler 67 of the first planner portion 60 of the movable touch piece 46 is not restricted to the above embodiments. For example, as illustrated in FIG. 14, a coupler 167 with both ends caulked and fixed with the first and second movable contacts 61, 62 may be formed of a member different from the member for the movable touch piece 46, and may be coupled to the tip of the arm 66. Further, as illustrated in FIG. 15, a plate-shaped coupler 267 bent at the center is used to couple the free ends so as to cover the surface of the movable contacts.

The movable touch piece 46 may have a pair of arms 66 with different lengths. Even in this case, one or more embodiments can be applied as long as the first and second movable contacts 61, 62 and the first and second fixed portions 64, 65 are disposed so as to satisfy: the spring constants k1, k2>the spring constant k3; and the direct distances L1, L2>the direct distance L4.

The opening 68 is not restricted to have the triangular shape illustrated in FIG. 5. For example, the opening 68 may have a rectangular shape as illustrated in FIG. 14, or may have a circular shape, though not illustrated.

Naturally, the constituents described in the above embodiments may be appropriately combined, or may be appropriately selected, replaced, or deleted.

Example

Figure 16:
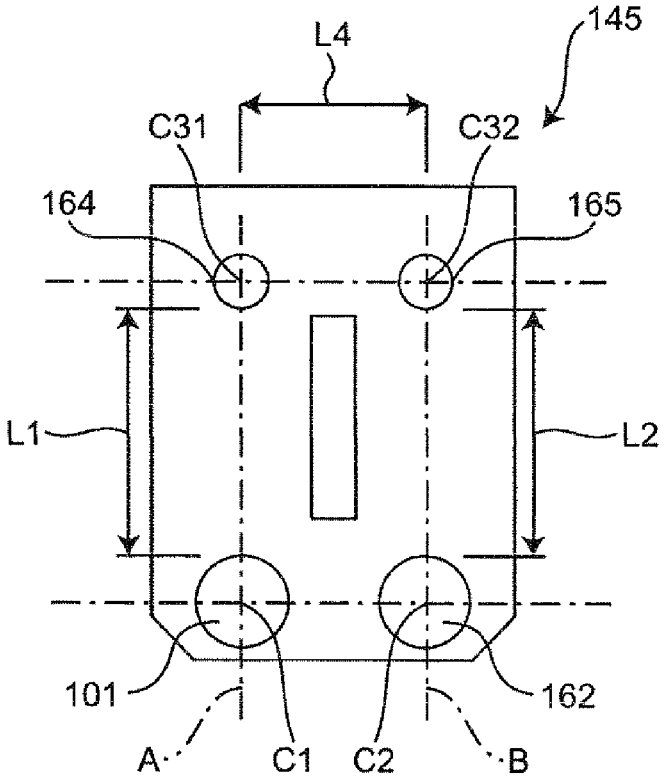
FIG. 16 is a view illustrating an example.

In a state where a first planner portion 160 of the movable touch piece 145 illustrated in FIG. 16 was caulked and fixed to the movable iron piece, a predetermined load was applied to a first movable contact 161, to analyze the relation among the first and second movable contacts 161, 162, the first and second fixed portions 164, 165, and displacement amounts of the first and second movable contacts 161, 162.

Specifically, the relation among the following was analyzed: a rate of the spring constant k3 between the first and second movable contacts 161, 162 assuming that the spring constant k1 of the first planner portion 160 between the first movable contact 161 and the first fixed portion 164 is 100%; a rate (L1/L4) of the direct distance L1 from the first movable contact 161 to the first fixed portion 164 with respect to the direct distance L4 between the first and second fixed portions 164, 165; and a change rate (H2/H1) of a displacement amount (H2) of the second movable contact 162 with respect to a displacement amount (H1) of the first movable contact 161 at the time of application of a predetermined load to the first movable contact 161.

Note that the movable touch piece 145 illustrated in FIG. 16 is formed such that the spring constant k2 of the first planner portion 160 between the second movable contact 162 and the second fixed portion 165 is equal to the spring constant k1 of the first planner portion 160 between the first movable contact 161 and the first fixed portion 164, and the direct distance L2 from the second movable contact 162 to the second fixed portion 165 is equal to the direct distance L1 from the first movable contact 161 to the first fixed portion 164.

TABLE 1

| Spring constants k1, k2 | Spring constant k3 | L1/L4 | H1 (mm) | H2 (mm) | H2/H1 (%) |
|---|---|---|---|---|---|
| 100% | 85.7% | 200.0% | 0.274 | 0.096 | 35.078 |
| 100% | 85.7% | 300.0% | 0.074 | 0.027 | 36.431 |
| 100% | 85.7% | 200.0% | 0.067 | 0.025 | 37.782 |
| 100% | 88.2% | 150.0% | 0.062 | 0.026 | 41.916 |
| 100% | 85.7% | 120.0% | 0.062 | 0.026 | 42.084 |
| 100% | 88.2% | 133.3% | 0.061 | 0.026 | 43.026 |
| 100% | 88.2% | 120.0% | 0.060 | 0.027 | 44.281 |
| 100% | 97.1% | 226.7% | 0.093 | 0.042 | 45.127 |
| 100% | 97.1% | 170.0% | 0.088 | 0.041 | 46.605 |
| 100% | 92.3% | 150.0% | 0.059 | 0.028 | 47.632 |
| 100% | 97.1% | 136.0% | 0.086 | 0.042 | 48.594 |

TABLE 2

| Spring constants k1, k2 | Spring constant k3 | L1/L4 | H1 (mm) | H2 (mm) | H2/H1 (%) |
|---|---|---|---|---|---|
| 100% | 88.2% | 88.2% | 0.064 | 0.032 | 50.085 |
| 100% | 100.0% | 136.0% | 0.085 | 0.043 | 50.719 |
| 100% | 90.0% | 95.0% | 0.076 | 0.038 | 50.799 |
| 100% | 100.0% | 150.0% | 0.057 | 0.029 | 50.971 |
| 100% | 100.0% | 133.3% | 0.056 | 0.029 | 52.065 |
| 100% | 92.6% | 92.6% | 0.073 | 0.038 | 52.240 |
| 100% | 105.0% | 180.0% | 0.067 | 0.035 | 52.542 |
| 100% | 100.0% | 120.0% | 0.056 | 0.030 | 53.257 |
| 100% | 105.0% | 157.5% | 0.065 | 0.035 | 53.400 |
| 100% | 97.1% | 97.1% | 0.093 | 0.051 | 54.264 |
| 100% | 105.0% | 140.0% | 0.064 | 0.035 | 54.421 |
| 100% | 105.0% | 126.0% | 0.064 | 0.036 | 55.526 |
| 100% | 100.0% | 100.0% | 0.091 | 0.050 | 55.586 |
| 100% | 113.3% | 170.0% | 0.081 | 0.046 | 57.258 |
| 100% | 105.0% | 105.0% | 0.066 | 0.038 | 58.088 |
| 100% | 113.3% | 151.1% | 0.080 | 0.046 | 58.121 |
| 100% | 113.3% | 136.0% | 0.080 | 0.047 | 59.104 |
| 100% | 113.3% | 113.3% | 0.095 | 0.059 | 62.225 |
| 100% | 130.0% | 195.0% | 0.119 | 0.076 | 63.828 |
| 100% | 130.0% | 173.3% | 0.118 | 0.076 | 64.431 |
| 100% | 130.0% | 130.0% | 0.121 | 0.081 | 66.929 |
| 100% | 136.0% | 136.0% | 0.075 | 0.052 | 69.294 |
| 100% | 146.7% | 146.7% | 0.170 | 0.122 | 71.572 |
| 100% | 156.0% | 156.0% | 0.112 | 0.083 | 74.197 |
| 100% | 170.0% | 170.0% | 0.071 | 0.055 | 77.751 |
| 100% | 176.0% | 176.0% | 0.159 | 0.124 | 78.121 |
| 100% | 195.0% | 195.0% | 0.107 | 0.087 | 81.637 |
| 100% | 220.0% | 220.0% | 0.153 | 0.130 | 84.696 |

As illustrated in Table 1, it was found that, when the spring constants k1, k2 are larger than the spring constant k3 and the direct distance L1 is longer than the direct distance L4, the change rate H2/H1 is smaller than 50%.

On the other hand, as illustrated in Table 2, it was found that, when the spring constant k3 is larger than the spring constants k1, k2 and the direct distance L1 is shorter than the direct distance L4, the change rate H2/H1 is larger than 50%.

That is, it was found that, by disposing the first and second movable contacts 161, 162 and the first and second fixed portions 164, 165 so as to satisfy: the spring constants k1, k2>the spring constant k3; and the direct distances L1, L2>the direct distance L4, the change rate in displacement of the other movable contact is not larger than 50% at the time when a load is applied to one movable contact. In the case of this change rate being not larger than 50%, even when a foreign matter which could be generated in normal use, such as resin waste generated in manufacturing of an electromagnetic relay, was mixed between one movable contact and one fixed contact and a gap was formed between the one movable contact and the one fixed contact, it was possible to keep the state of contact between the other movable contact and the other fixed contact.

INDUSTRIAL APPLICABILITY

The contact mechanism according to one or more embodiments is not restricted to, for example, the electromagnetic relay of the above embodiments, but can be applied to an electromagnetic relay having another configuration.

DESCRIPTION OF SYMBOLS

10 base
11 coil terminal hole
12 fixed terminal hole
13 wall
14 step
20 electric magnet device
21 spool
211 body
212 through hole
22 first guard portion
221 projection
23 second guard portion
231 attachment
232 recess
233 attachment
24 third guard portion
241 notch
25 coil
26 iron core
261 magnetic pole portion
262 caulking portion
27 yoke
271 vertical portion
272 horizontal portion
273 terminal portion
274 protrusion
28 coil terminal
281 binding piece
29 position regulation member
30 movable iron piece
31 protrusion
40 contact mechanism
41 fixed contact terminal
42 first fixed contact
43 second fixed contact
44 fixed terminal
45 press-fit portion
46 movable touch piece
50 cover
60 first planar portion
61 first movable contact
62 second movable contact
63 through hole
64 first fixed portion
65 second fixed portion
66 arm
67 coupler
68 opening
70 second planar portion
71 first through hole
72 second through hole
80, 81, 82, 83, 84, 84 caulking portion
100 electromagnetic relay
145 movable touch piece
160 first planar portion
161 first movable contact
162 second movable contact
164 first fixed portion
165 second fixed portion
167 coupler
267 coupler

The invention claimed is:

1. A contact mechanism comprising:

a movable touch piece comprising:

at least one fixed portion;

a pair of arms forked from the fixed portion and respectively comprising free ends;

first and second movable contacts provided at the respective free ends of the pair of arms; and a coupler configured to couple the free ends of the pair of arms; and first and second fixed contacts disposed respectively facing the first and second movable contacts and configured to connect and separate from the first and second movable contacts, wherein the pair of arms is elastically deformed by a first force and the coupler is elastically deformed by a second force, wherein the second force is smaller than the first force, wherein an intersection of a straight line and a peripheral edge of the fixed portion comprises a first fixed portion, the straight line connecting between a center of the first movable contact and a center of the fixed portion disposed at a position with a shortest direct distance to the first movable contact, an intersection of a straight line and a peripheral edge of the fixed portion comprises a second fixed portion, the straight line connecting between a center of the second movable contact and a center of the fixed portion disposed at a position with a shortest direct distance to the second movable contact, and in response to the center of the first movable contact, the center of the second movable contact, the first fixed portion, and the second fixed portion being located at respective apexes of a quadrangle and the center of the first movable contact and the second fixed portion are disposed at opposite corners of the quadrangle, a spring constant of the movable touch piece between the first movable contact and the first fixed portion and a spring constant of the movable touch piece between the second movable contact and the second fixed portion are larger than a spring contact of the movable touch piece between the first and second movable contacts, and the direct distance between the first movable contact and the first fixed portion and the direct distance between the second movable contact and the second fixed portion are longer than a direct distance between the first and second fixed portions.

2. The contact mechanism according to claim 1, wherein the pair of arms and the coupler are members different from each other.

3. An electromagnetic relay comprising the contact mechanism according to claim 2.

4. An electromagnetic relay comprising the contact mechanism according to claim 1.

* * * * *